US006499739B1

(12) United States Patent
Brown

(10) Patent No.: US 6,499,739 B1
(45) Date of Patent: Dec. 31, 2002

(54) RESTAURANT THEME BOARD GAME

(76) Inventor: Theresa A. Brown, 35 McKinley Ave., Hawthorne, NJ (US) 07506

( * ) Notice: Subject to any disclaimer, the term of this patent is extended or adjusted under 35 U.S.C. 154(b) by 0 days.

(21) Appl. No.: 09/716,534

(22) Filed: Nov. 20, 2000

(51) Int. Cl.[7] ..... A63F 3/00

(52) U.S. Cl. ..... 273/242; 273/243; 273/248; 273/432

(58) Field of Search ..... 273/243, 248–254, 273/429–432, 242

(56) References Cited

U.S. PATENT DOCUMENTS

| | | | |
|---|---|---|---|
| 2,693,961 A | * | 11/1954 | Ripley, Jr. |
| 3,602,512 A | | 8/1971 | Krugier |
| 4,040,629 A | | 8/1977 | Kelly |
| 4,146,233 A | | 3/1979 | Musolino |
| 4,174,840 A | | 11/1979 | Curtiss |
| 4,266,775 A | | 5/1981 | Chitnis et al. |
| 4,557,486 A | | 12/1985 | Stuckmayer |
| 4,640,513 A | | 2/1987 | Montijo |
| 4,733,869 A | | 3/1988 | Dapper et al. |
| 4,948,146 A | | 8/1990 | Snyder et al. |
| 4,984,805 A | | 1/1991 | Medlock |
| 5,005,839 A | | 4/1991 | Ryan et al. |

* cited by examiner

*Primary Examiner*—Benjamin H. Layno
(74) *Attorney, Agent, or Firm*—Richard M. Goldberg

(57) ABSTRACT

A restaurant theme board game and a method of play, includes a playing surface; a playing piece for each player, and a course to be traversed by the playing pieces. The course includes waitress stations, each player's playing piece occupying a respective station. Each waitress station includes tables wherein each player required to traverse the tables of its waitress station five times to complete five levels. Each level must be traversed within a predetermined period of time. Question cards must be answered by each player during that player's turn in order for the player's playing piece to proceed along tables of the player's station. Money awards are given for correctly answering the questions. The first player who completely traverses the tables for each level within the predetermined time period and accumulates more rewards than any other player, wins the game.

21 Claims, 9 Drawing Sheets

FIG. 3

22a

| Pizza Toppings | | | |
|---|---|---|---|
| | | | |
| | Pepperoni | | |
| | Sausage | | |
| | Bacon | | |
| | Mushroom | | |
| | Onion | | |
| | Meatball | | |
| | Garlic | | |
| | Broccoli | | |
| | Peppers | | |
| | Olives | | |
| | | | |
| | | | |
| | TAX | | |
| | | | |
| | *Thank You - Call Again* | | |
| NO. PERSONS | DATE | CHECK NO. 774605 | AMOUNT |

FIG. 4

22b

| Soups | | | |
|---|---|---|---|
| | | | |
| | Chicken Noodle | | |
| | Tomato | | |
| | Lentil | | |
| | Split Pea | | |
| | Vegetable | | |
| | Minnestrone | | |
| | Clam Chowder | | |
| | (Manhattan/ New England) | | |
| | Beef Barley | | |
| | Matza Ball | | |
| | Black Bean | | |
| | | | |
| | TAX | | |
| | | | |
| | *Thank You - Call Again* | | |
| NO. PERSONS | DATE | CHECK NO. 774606 | AMOUNT |

FIG. 7

22e

| Cordials | | | |
|---|---|---|---|
| | | | |
| | Amaretto | | |
| | Anisette | | |
| | B + B | | |
| | Bialeys | | |
| | Kahluha | | |
| | Sambuca | | |
| | Hennessey | | |
| | Courvoissier | | |
| | Remy Martin VSOP | | |
| | Drambuie | | |
| | | | |
| | | | |
| | TAX | | |
| | | | |
| | *Thank You - Call Again* | | |

| NO. PERSONS | DATE | CHECK NO. | AMOUNT |
|---|---|---|---|
| | | 774989 | |

FIG. 8

22f

| Basic Wines | | | |
|---|---|---|---|
| | | | |
| | Chardonnay | | |
| | Chablis | | |
| | Pinot Noir | | |
| | Riesling | | |
| | Chianti | | |
| | Burgandy | | |
| | Cabernet | | |
| | Merlot | | |
| | Zinfandel | | |
| | Rose | | |
| | | | |
| | | | |
| | TAX | | |
| | | | |
| | *Thank You - Call Again* | | |

| NO. PERSONS | DATE | CHECK NO. | AMOUNT |
|---|---|---|---|
| | | 774991 | |

FIG. 9

22g

| | | | |
|---|---|---|---|
| | Homemade Cookies | | |
| | | | |
| | Sugar | | |
| | Peanut Butter | | |
| | Chocolate | | |
| | Chocolate Chip | | |
| | Oatmeal | | |
| | Butter | | |
| | Oatmeal Raisin | | |
| | Butterscotch | | |
| | Gingersnaps | | |
| | Chocolate Walnut | | |
| | | | |
| | | | |
| | TAX | | |
| | | | |
| | *Thank You - Call Again* | | |
| NO. PERSONS | DATE | CHECK NO. 774674 | AMOUNT |

FIG. 10

22h

| | | | |
|---|---|---|---|
| | Things You Stuff | | |
| | | | |
| | Turkey | | |
| | Chicken | | |
| | Mushrooms | | |
| | Tomatoes | | |
| | Peppers | | |
| | Cabbage | | |
| | Filet of Sole | | |
| | Shells | | |
| | Lamb/Pork Chops | | |
| | Your Stomach | | |
| | | | |
| | | | |
| | TAX | | |
| | | | |
| | *Thank You - Call Again* | | |
| NO. PERSONS | DATE | CHECK NO. 774677 | AMOUNT |

FIG. 11

22i

| Bar Utensils | | | |
|---|---|---|---|
| | | | |
| | Blender | | |
| | Strainer | | |
| | Wine/Bottle Opener | | |
| | Cocktail Shaker | | |
| | Barspoon | | |
| | Ice Bucket | | |
| | Jigger | | |
| | Muddler | | |
| | Pourer | | |
| | Measuring Glass | | |
| | | | |
| | | | |
| | TAX | | |
| | | | |
| | *Thank You - Call Again* | | |
| | | | |
| NO. PERSONS | DATE | CHECK NO. 774709 | AMOUNT |

FIG. 12

22j

| Popular Fruit Desserts | | | |
|---|---|---|---|
| | | | |
| | Bananas Foster | | |
| | Ambrosia | | |
| | Peach Melba | | |
| | Poached Pears | | |
| | Chocolate Covered Strawberries | | |
| | Poires Helene | | |
| | Pineappple Upsidedown Cake | | |
| | Peaches/Cream | | |
| | Coconut Custard | | |
| | Apricot Compote | | |
| | Apple Pie | | |
| | | | |
| | TAX | | |
| | | | |
| | *Thank You - Call Again* | | |
| | | | |
| NO. PERSONS | DATE | CHECK NO. 774710 | AMOUNT |

FINAL ROUND

WHICH IS NOT AN INGREDIENT WHEN MAKING HOLLANDAISE SAUCE?

A. WHOLE EGGS
B. BUTTER
C. EGG YOLKS
D. VINEGAR $200.00

50

100

| CORRECT ANSWERS | TIP (DOLLARS) |
|---|---|
| 1 | $2 |
| 2 | $4 |
| 3 | $6 |
| 4 | $8 |

RESTAURANT THEME BOARD GAME

BACKGROUND OF THE INVENTION

The present invention relates generally to board games, and more particularly, is directed to a board game having a restaurant theme having a plurality of different elements of play and in which two distinct conditions must be met to win.

Board games are known in which players must traverse a course, with the winner being the first player to reach a finish line. Further, board games, such as that sold under the trademark TRIVIAL PURSUIT are known in which a player traverses a game board and must answer questions, with the first person to correctly answer a predetermined number of questions being declared the winner. Board games are also known in which a person with the most money wins. In the above games, only one condition for winning is provided.

Further, although games are known in which a player must traverse a course, the course is the same course for all players.

OBJECTS AND SUMMARY OF THE INVENTION

Accordingly, it is an object of the present invention to provide a board game that overcomes the problems with the aforementioned prior art.

It is another object of the present invention to provide a board game having different elements which come into play during the game.

It is still another object of the present invention to provide a board game in which the different elements are positioning of a playing piece by completion of the course, correctly answering questions, time and accumulation of rewards.

It is yet another object of the present invention to provide a board game in which two distinct conditions must be met by a player to win the game.

It is a further object of the present invention to provide a board game in which the two conditions that must be met are completion of the course by correctly answering questions and the accumulation of the most rewards.

It is a still further object of the present invention to provide a board game in which each person is provided with their own course to traverse.

It is a yet further object of the present invention to provide a board game in which the course to be traversed includes a plurality of tables at a restaurant station.

It is another object of the present invention to provide a board game in which each player must traverse his or her course a plurality of times.

It is still another object of the present invention to provide a board game in which there is a time limit for traversing each course during a player's turn.

In accordance with an aspect of the present invention, a board game to be played by a plurality of playing entities, includes a playing surface; a playing piece for each playing entity; a course to be traversed on the playing surface within a predetermined time period by the playing piece of each playing entity; a plurality of traverse questions which must be answered by each playing entity during that playing entity's turn in order for the playing piece of the playing entity to proceed along the course; a time keeping device for determining when the predetermined time period has expired during a playing entity's turn such that failure to completely traverse the course during a playing entity's turn requires the playing entity to complete the course during a subsequent turn; rewards provided to each playing entity for correctly answering the questions during traverse of the course by the respective playing entity; and a playing entity which first satisfies both conditions of completely traversing the course within the predetermined time period and accumulating more rewards than any other playing entity, wins the game.

Preferably, the course to be traversed includes a plurality of stations on the playing surface such that the playing piece of each playing entity occupies a respective station, and each station includes a plurality of positions to be traversed by the playing piece of the playing entity occupying the station within the predetermined period of time. Each playing entity is required to traverse the positions of the station occupied by the playing entity a plurality of times to complete a plurality of different levels, with each traverse being performed for each level within the predetermined period of time. In a most preferred embodiment, the board game has a restaurant theme, with the stations comprising waitress stations and the positions comprising tables to be waited on, and the questions including questions regarding at least one of food, drink and restaurant services.

Further, each playing entity is required to start at an ending position of the course at each start of a playing entity's turn, although a playing entity is permitted to traverse the course for a next level after the playing entity has completed traverse of the course for a level within the predetermined period of time, provided that the predetermined period of time has not elapsed.

The board game further includes a bonus card to be provided to a playing entity after the playing entity completes a level, with the bonus card providing an additional reward or a reward subtraction. The board game also includes a final round question to be answered by a playing entity during the playing entity's turn when the playing entity has completed traverse of all levels of the course, each within the predetermined time period, and the playing entity has accumulated less rewards than another playing entity; and an additional reward is provided to the playing entity for correctly answering the final round question to enable the playing entity to satisfy both conditions of completing traverse of the course within the predetermined time period and accumulating more rewards than any other playing entity, in order to win. The rewards preferably include monetary rewards.

In accordance with another aspect of the present invention, a restaurant theme board game to be played by a plurality of playing entities, includes a playing surface; a playing piece for each playing entity; a course to be traversed on the playing surface by the playing piece of each playing entity, the course to be traversed including a plurality of waitress stations on the playing surface such that the playing piece of each playing entity occupies a respective station, and each waitress station includes a plurality of tables to be traversed by the playing piece of the playing entity occupying the station, with each playing entity required to traverse the tables of the waitress station occupied by the playing entity a plurality of times to complete a plurality of different levels, and with each traverse of all tables of the waitress station being performed for each level within a predetermined period of time; a plurality of traverse questions which must be answered by each playing entity during that playing entity's turn in order for the playing piece of the playing entity to proceed along tables of the playing entity's station, the questions including questions regarding at least one of food, drink and restaurant services; a time keeping device for determining when the predetermined time period has expired during a playing entity's turn such that failure to completely traverse all tables of the station occupied by the playing entity during a playing entity's turn requires the playing entity to complete the course during a subsequent turn; rewards provided to each playing entity for correctly answering the questions during traverse of the course by the respective playing entity; and a playing entity which first satisfies both conditions of completely traversing the tables at the station occupied by the playing entity for each level within the predetermined time period and accumulating more rewards than any other playing entity, wins the game.

In accordance with still another aspect of the present invention, a method of playing a board game, includes the steps of requiring a predetermined course to be traversed at least once within a predetermined period of time; requiring questions to be answered by a playing entity to move a playing piece of the playing entity along the course; moving the playing piece of the playing entity along the course when the playing entity correctly answers each question during the predetermined period of time; providing rewards to each playing entity for correctly answering the questions during traverse of the course; and requiring a playing entity to satisfy both conditions of completing traverse of the course within the predetermined time period and accumulating more rewards than any other playing entity, in order to win.

Specifically, a plurality of stations are provided on the playing surface such that each playing entity occupies a respective station, each station including a plurality of tables forming a course to be traversed by the playing piece of one playing entity within a predetermined time period.

The step of requiring a predetermined course to be traversed at least once within a predetermined period of time includes the steps of requiring a playing entity to traverse the course a plurality of times to complete a plurality of different levels, and requiring a playing entity to traverse the course for each level within the predetermined period of time, with each playing entity required to start at an ending position of the course at each start of the playing entity's turn.

Further, a playing entity is permitted to traverse the course for a next level after the playing entity has completed traverse of the course for a level within the predetermined period of time, provided that the predetermined period of time has not elapsed.

The method further includes the steps of providing a bonus card to a playing entity after a playing entity completes a level; and adding or subtracting from rewards of the playing entity in accordance with instructions from the bonus card. In addition, the method includes the steps of providing a final round question to a playing entity during the playing entity's turn when the playing entity has completed traverse of the course within the predetermined time period but has accumulated less rewards than another playing entity; and providing an additional reward to the playing entity for correctly answering the final round question to enable the playing entity to satisfy both conditions of completing traverse of the course within the predetermined time period and accumulating more rewards than any other playing entity, in order to win.

The above and other objects, features and advantages of the invention will become readily apparent from the following detailed description thereof which is to be read in connection with the accompanying drawings.

BRIEF DESCRIPTION OF THE DRAWINGS

FIG. 3 is a plan view of a first CHECK card for the first level;

FIG. 4 is a plan view of a second CHECK card for the first level;

FIG. 7 is a plan view of a first CHECK card for the third level;

FIG. 8 is a plan view of a second CHECK card for the third level;

FIG. 9 is a plan view of a first CHECK card for the fourth level;

FIG. 10 is a plan view of a second CHECK card for the fourth level;

FIG. 11 is a plan view of a first CHECK card for the fifth level;

FIG. 12 is a plan view of a second CHECK card for the fifth level;

DETAILED DESCRIPTION

Figure 1:
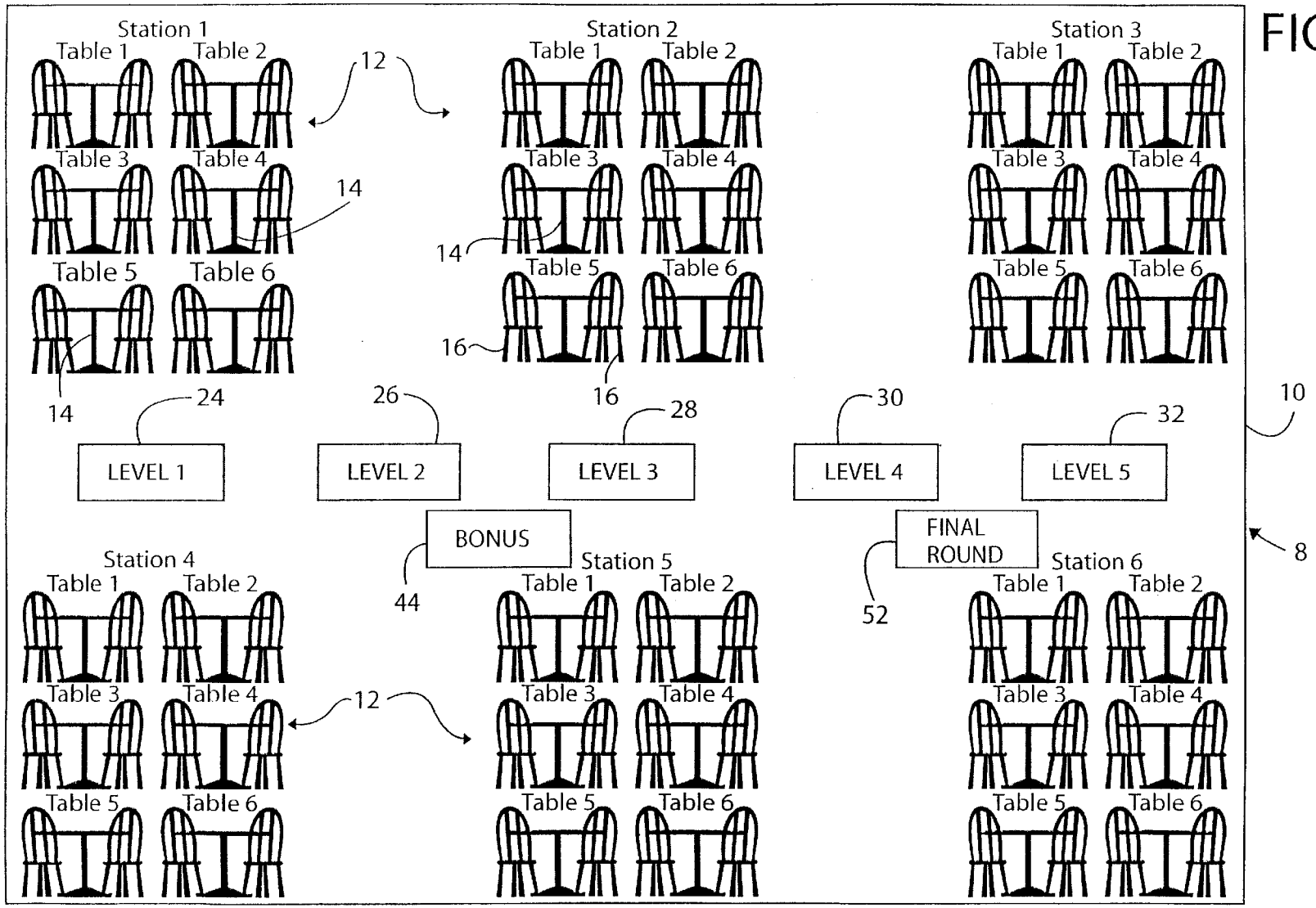
FIG. 1 is a top plan view of the game board of the present invention.

Referring to the drawings in detail, an initially to FIG. 1, a board game 8 according to the present invention includes a game board 10 of cardboard, paper, plastic or any other suitable material that can be laid flat. Although game board 10 is shown in a rectangular configuration, the present invention is not limited thereby, and any other suitable shape can be used.

Game board 10 is provided with a plurality of waitress stations 12, each with a plurality of tables 14. Two chairs 16 are shown around each table 14. Although not limited thereto, there are preferably six stations 12 denoted as Station 1, Station 2, Station 3, Station 4, Station 5 and Station 6. Further, although not limited thereto, each station 12 preferably has six tables 14 denoted as Table 1, Table 2, Table 3, Table 4, Table 5 and Table 6. Each player occupies only one station 12. Thus, for example, a first player will occupy Station 1, a second player will occupy Station 2, and so on. As will be understood from the description which follows, the six tables 14 of each station 12 correspond to a course that must be traversed by the player which occupies that station 12. The stations are not limited to this particular arrangement. For example, six chairs can be placed around a single table or adjacent a bar or countertop, so as to denote different restaurant arrangements. In such case, the six chairs would take the place of Tables 1–6.

For purposes of traversing tables 14 of the respective station 12, each player is provided with a playing piece 18. Alternatively, a team of players can occupy each station, and in such case, a single playing piece 18 is provided at that station for the team. For ease of explanation hereinafter, the game will be discussed with a single player at each playing station. For purposes herein, reference to a playing entity refers to a single player or team.

Figure 2:
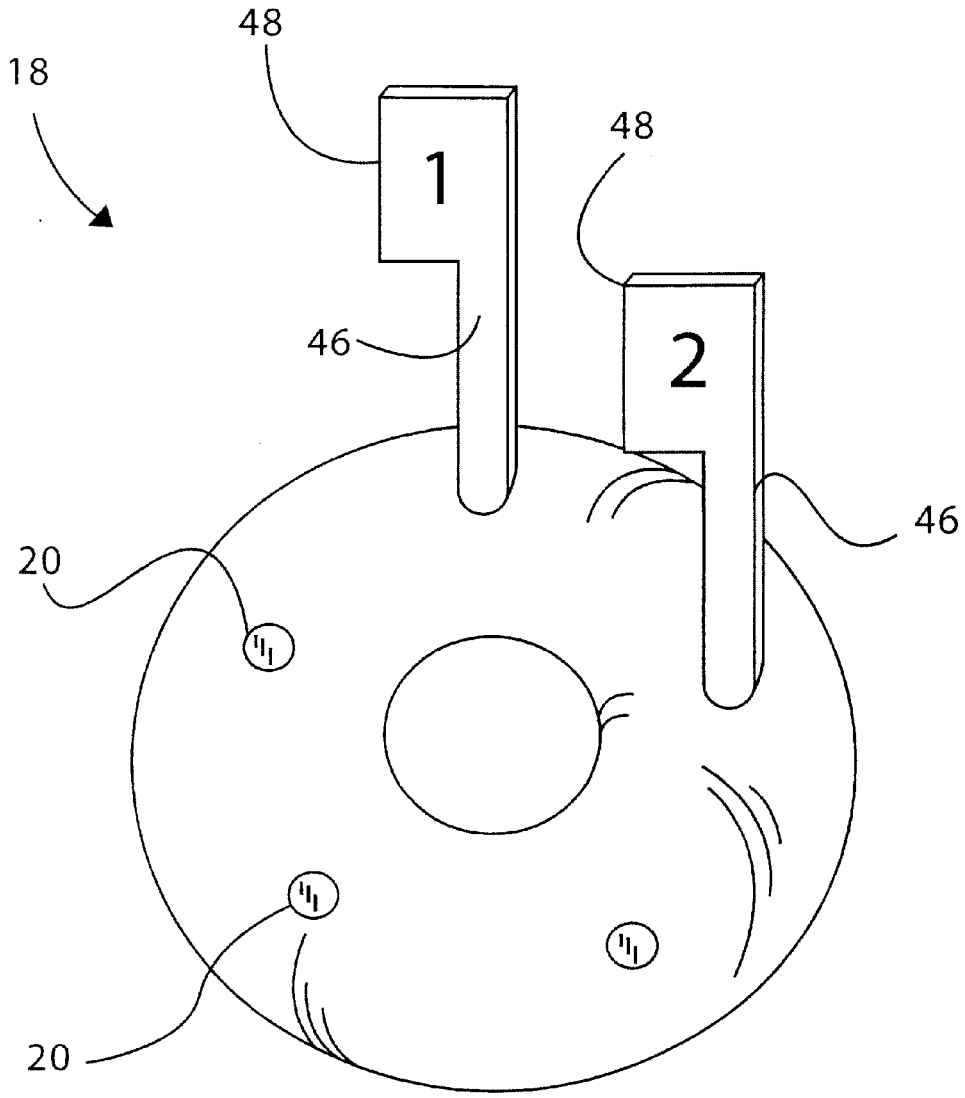
FIG. 2 is a perspective view of a playing piece in the shape of a doughnut.

Playing pieces 18 can take any suitable form, although a preferred form of playing piece 18 can be, for example, a doughnut, as shown in FIG. 2, having five small holes 20 in the upper surface thereof. Thus, the first player will position his doughnut 18 at Table 1 of Station 1, the second player will position his doughnut 18 at Table 1 of Station 2, etc. at the start of the game.

Figures 15, 16, 17:
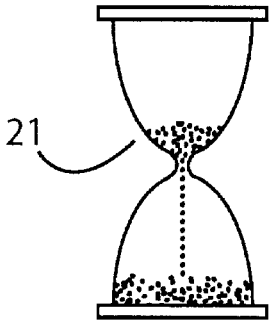
FIG. 15 is a plan view of a FINAL ROUND card.
FIG. 16 is an elevational view of an hourglass timer.
FIG. 17 is a plan view of a tip card.

A player must traverse the course of Table 1 through Table 6 of the player's station 12, a plurality of, for example, five times, each corresponding to a different level. Each level must be traversed during a predetermined time period of, for example, 60 seconds. The timing can be achieved by any suitable means, such an hourglass 21 which is turned over to start the 60 second time period, as shown in FIG. 16.

In order to traverse the course, that is, to proceed from one table 14 to the next table 14 at the player's station 12, the player must correctly answer traverse questions from CHECK cards 22 placed in respective level areas 24, 26, 28, 30 and 32 of game board 10. Level areas 24–32 can be eliminated and cards 22 merely placed in different piles to the outside of the board. CHECK cards 22 are provided for each level, and preferably are more difficult to answer for each level, although this is not a requirement of the game. Thus, CHECK cards 22 for a first level are placed in first level area 24 designated LEVEL 1 on game board 10; CHECK cards 22 for a second level are placed in second level area 26 designated LEVEL 2 on game board 10; CHECK cards 22 for a third level are placed in third level area 28 designated LEVEL 3 on game board 10; CHECK cards 22 for a fourth level are placed in fourth level area 30 designated LEVEL 4 on game board 10; and CHECK cards 22 for a fifth level are placed in fifth level area 32 designated LEVEL 5 on game board 10.

CHECK cards 22 preferably relate to the restaurant theme, and also preferably, are in the form of restaurant checks to further this theme. CHECK cards 22 are provided for each level, with the level printed on the back of each CHECK card 22.

Samples of CHECK cards 22 for the first level are provided in FIGS. 3 and 4. Specifically, as shown in FIG. 3, a first CHECK card 22*a* for the first level requires a player to name four of the ten toppings that are conventionally found on pizza and which are listed on CHECK card 22*a*. If the player cannot name four of the ten toppings before the sixty second time period ends, the player's turn ends. If the player correctly names four of the ten listed pizza toppings, the player's playing piece 18 is advanced to Table 2 of Station 1. The player is then requested to name four of the ten soups listed on the next CHECK card 22*b* shown in FIG. 4. If the player correctly names four of the ten soups, the player's playing piece 18 is advanced to Table 3 of Station 1, and so on. This operation proceeds until the player correctly answers the questions at Table 6. At this time, the player has completed Level 1. However, all six questions at Table 1 through Table 6 must be correctly answered during the 60 second time period to proceed to the next level. If the 60 second time period expires before the player correctly answers the questions at Table 6 of that level, the player restarts that same level during the next turn of the player at the location where the player was at the previous turn.

Figure 13:
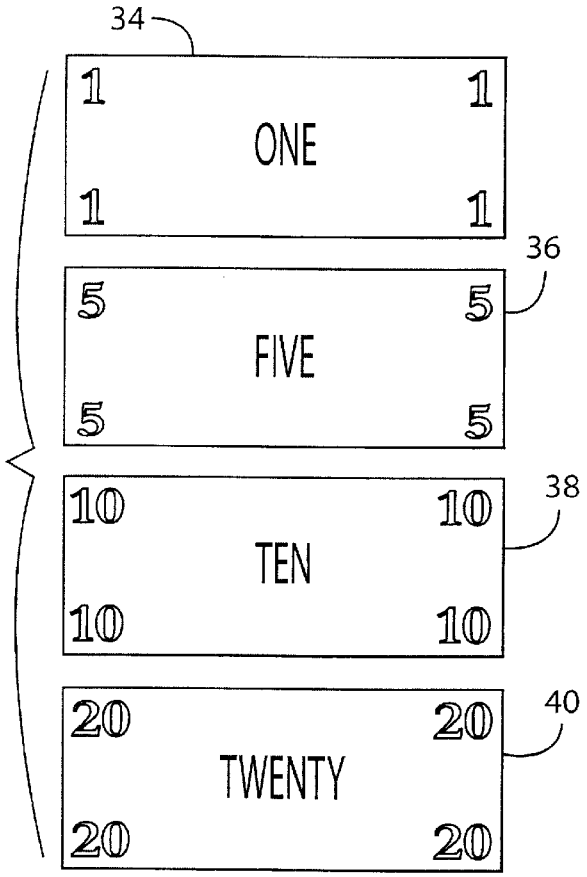
FIG. 13 is a plan view of the currency used in the game.

For each correct answer, the player receives a monetary reward, that is, a tip. Thus, for example, the player may receive one dollar for each correct answer. For this purpose, play money in the form of one dollar bills 34, five dollar bills 36, ten dollar bills 38 and twenty dollar bills 40 can be used, as shown in FIG. 13. Alternatively, other rewards may be provided, for example, a point reward system, a token reward system, etc. In the case of CHECK card 22*a* in FIG. 3, the player must name at least four pizza toppings to proceed to the next Table 2.

Figure 14:
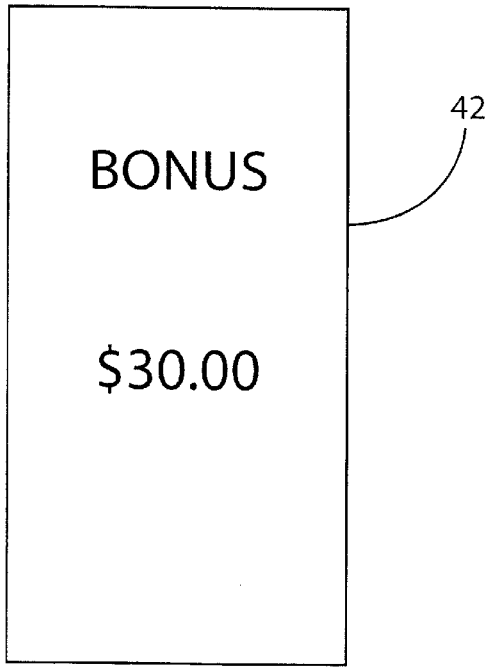
FIG. 14 is a plan view of a BONUS card.

At the end of each level, a BONUS card 42 (FIG. 14) is picked from a card pile in a bonus area 44 on game board 10. BONUS card 42 provides a further monetary reward or a monetary subtraction.

For each correct target answer given at each table 14, the player receives an additional gratuity, namely money. For example, and with reference to the tip card 100 of FIG. 17, if a player provides four correct answers at a table, the player gets the full 15% gratuity of, for example, eight dollars. For less than four correct answers, the player will get a monetary tip less than 15% as indicated on tip card 100.

Upon completion of a level, the player receives a pin 46 having a flag 48 thereon with the number of the completed level preferably on the flag 48. Alternatively, the number can be eliminated and replaced by a color coding corresponding to the level. Pin 46 is positioned in a hole 20 of playing piece 18 to indicate the levels that have been completed.

Figure 5:
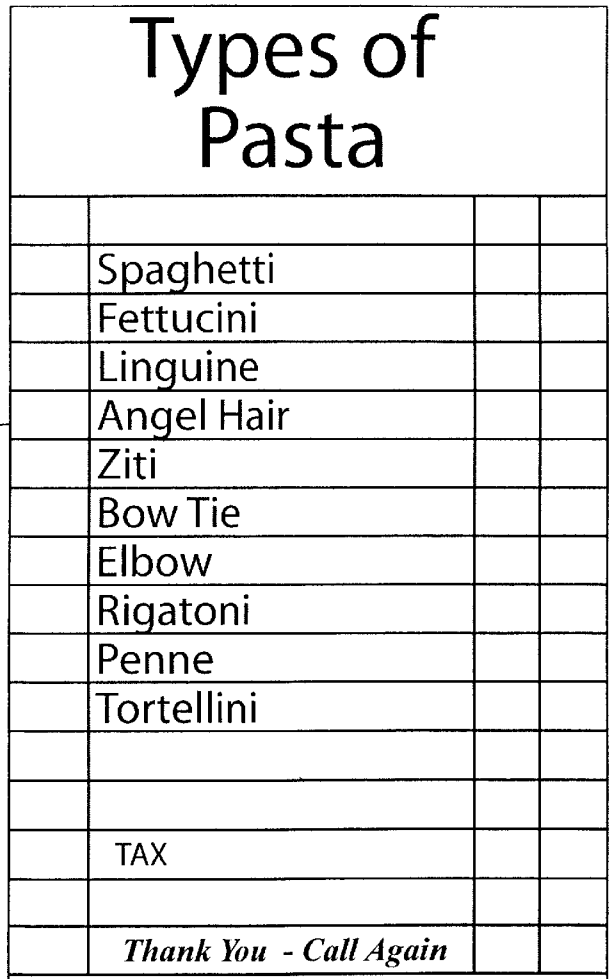
FIG. 5 is a plan view of a first CHECK card for the second level.
Figure 6:
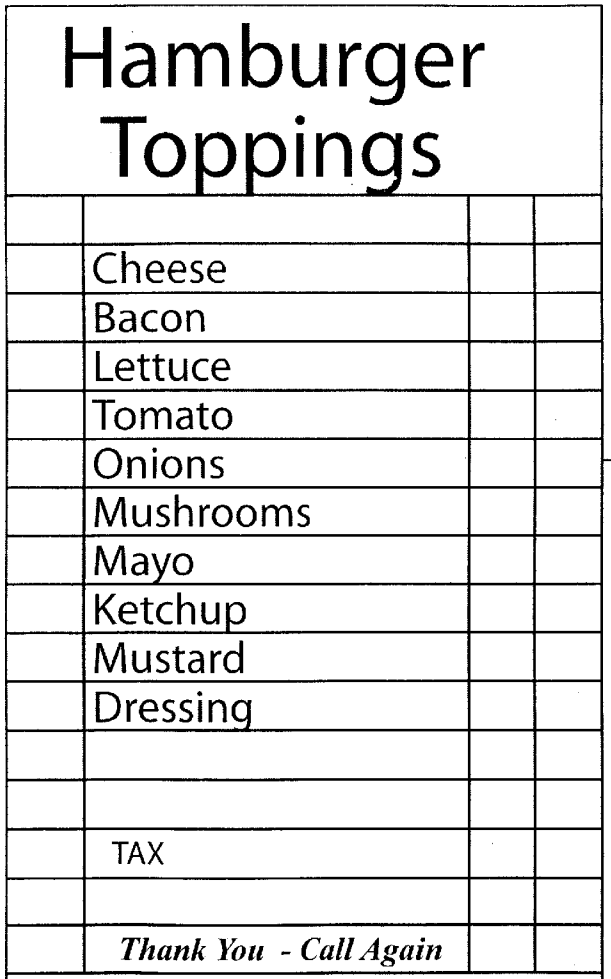
FIG. 6 is a plan view of a second CHECK card for the second level.

After a player completes a level and obtains the BONUS card 42, the player can continue to the next level during the same turn, as long as the sixty second time period has not expired. Thus, after completing the first level, the player's playing piece 18 is returned to Table 1 of the player's station 12, and a first question is asked from a CHECK card 22 in a stack in second level area 26. If the player completes the second level during the sixty second time period, the player can continue to the third level, and so on. Sample check cards 22*c* (FIG. 5) and 22*d* (FIG. 6) are shown for the second level; sample check cards 22*e* (FIG. 7) and 22*f* (FIG. 8) are shown for the third level; sample check cards 22*g* (FIG. 9) and 22*h* (FIG. 10) are shown for the fourth level; and sample check cards 22*i* (FIG. 11) and 22*j* (FIG. 12) are shown for the fifth level.

If the player does not complete the second level during the sixty second time period, the player's turn ends, and the player must start at the same ending position for the second level during the player's next turn. However, during the partial completion of the second level, the player has accumulated additional money, which is used as one of the conditions for winning.

After the sixty second time period has ended, the second player gets a turn to traverse Station 2 through the different levels, and so on.

It will therefore be appreciated that different elements come into play during the game, namely, positioning of a playing piece 18 by completion of the course, correctly answering questions of CHECK cards 22, the sixty second time period, and accumulation of rewards in the form of money.

Winning the game depends upon two different conditions, namely having successfully completed all five levels and having more money than any other player. For example, the first player may finish the fifth level at Station 1 before any other player completes the fifth level. If, at this time, the first player also has the most money, the first player wins. However, the first player may finish all five levels before the other players and have less money than the second player because the second player has correctly answered more questions. In this case, the first player does not win, since the second condition of having the most money has not been satisfied. In such case, the game continues in turn, and the first player then has an opportunity during each turn to add to that player's accumulated money. Specifically, after the first player has finished all five levels and has less money than the second player, the first player, during each of the first player's turns, can answer a final round question from a FINAL ROUND card 50 (FIG. 15) of a stack in a final round area 52 on game board 10. Each final round question is preferably more difficult than the questions on CHECK cards 22, but in addition, is also worth much more, for example, $200.00 per question. Preferably, the final round questions are multiple choice questions. The player can only answer one final round question per turn.

For example, assume that the first player finishes level 5 at Station 1 with $2,000.00, while the second player is still traversing level 3, but has accumulated $2,100.00. In such case, during the first player's next turn, the first player can answer one final round question, and if answered correctly, the first player will receive $200.00, bringing the first player's total to $2,200.00. At such time, the first player will have completed all five levels and then have more money than the second player, thereby satisfying both conditions and winning the game.

Therefore, according to the present invention, there are different elements of three factors that come into play, namely, answering the questions correctly, traversing each level within the predetermined time period, and accumulating the most money. In this manner, the present invention provides a more interesting game to be played in view of the many different factors that are involved. In addition, it is necessary for the two conditions of traversing all five levels and accumulating the most money, to be met in order for a player to win.

In operation, CHECK cards 22 for all five levels are placed face down on the appropriate level area 24–32, BONUS cards 42 are placed face down in bonus area 44, and FINAL ROUND cards 50 are placed face down in final round area 52. Preferably, a person is selected as the Maitre D., who will ask all questions, although this can be made in a revolving manner. A player is selected to go first. This can be accomplished by any suitable means, such as additional station cards (not shown) which tells with which station 12 the player is associated, dice or any other means. Each player receives five color-coded course pins 46 with flags 48, and each player selects a food item to be used as the player's playing piece 18. Play can then begin.

Each player starts at Table 1 of their station 12. The Maitre D. will then start with the first player. The Maitre D. turns over hourglass 21 to start the time period running, and begins to ask questions to the first player from the Level 1 cards. If the first player answers four of the ten pizza toppings, for example, from CHECK card 22*a*, the player moves to Table 2 of Station 1, and so on, until the player correctly answers the questions at all six tables 14. The first player then picks a BONUS card 42. If the sixty second time period has not yet expired, the first player moves back to Table 1 of Station 1 and starts the second level, whereupon questions from CHECK cards 22 at second level area 26 are asked. In such case, a clock can be used which the player stops at the end of the first level in order to add the gratuities, before continuing to the second level.

If a player does not complete a level within the sixty second time period, the player's turn ends, and the player must start at the ending position of that station 12 for the same level at the player's next turn.

Like all tipped employees, the player's receive a reward or gratuity. For each correct target answer given, the player receives a gratuity. This is totaled by the Maitre D. or the player.

For each level that is completed, the appropriate numbered pin 46 and flag 48 is placed in a hole 20 in the player's playing piece 18. This keeps track of which level the player is on.

Each player goes in turn. To win the game, a player must have completed all five levels, as well as having the most gratuity. In the event that a player completes all five levels, but does not have the most gratuity, the player is no longer required to move along the tables 14 of the respective station 12. In such case, the player, on that player's turn, can simply increase their grauity by answering a final round question from a FINAL ROUND card 50. These are worth $200.00 per question, which is greater than the questions on CHECK cards 22. Preferably, the final round questions are multiple choice questions. If a final round question is incorrectly answered, the amount is not deducted from the player's total amount. However, the player will have to wait for their next turn to attempt to answer another final round question.

It will be appreciated that various modifications can be made to the present invention within the scope of the claims.

For example, although six different stations 12 have been shown. A single station 12 can be provided, with all players traversing the same course of the single station 12.

Further, although the present invention has been disclosed in regard to a physical board game 10, playing pieces 18, CHECK cards 22, monetary bills 34–40, BONUS cards 42 and FINAL ROUND cards 50, the present invention can also be played as a computer game with a monitor, or as a hand held computer game.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A board game to be played by a plurality of playing entities, comprising:

a playing surface;

a playing piece for each playing entity;

course means on said playing surface for traversing within a predetermined time period by the playing piece of each playing entity;

a plurality of traverse question means for answering by each playing entity during that playing entity's turn in order for the playing piece of the playing entity to proceed along said course means;

time keeping means for determining when said predetermined time period has expired during a playing entity's turn and for indicating that a playing entity must complete the course means during a subsequent turn when the playing entity has failed to completely traverse the course means during the playing entity's turn;

reward means for rewarding each playing entity for correctly answering the question means during traverse of said course means by the respective playing entity; and winning indication means for indicating a winner of the game as a playing entity which first satisfies both conditions of completely traversing said course means within said predetermined time period and accumulating more reward means than any other playing entity.

2. A board game according to claim 1, wherein:

said course means to be traversed includes a plurality of stations on said playing surface such that the playing piece of each playing entity occupies a respective said station, and each station includes a plurality of position means for traversing by the playing piece of the playing entity occupying said station within said predetermined period of time.

3. A board game according to claim 1, wherein said course means to be traversed includes a plurality of stations on said playing surface such that the playing piece of each playing entity occupies a respective said station, and each station includes a plurality of position means for traversing by the playing piece of the playing entity occupying said station a plurality of times to complete a plurality of different levels, with each traverse being performed for each level within said predetermined period of time.

4. A board game according to claim 3, wherein:

said board game has a restaurant theme, with said stations comprising waitress stations and said position means comprising tables to be waited on, and said question means include questions regarding at least one of food, drink and restaurant services.

5. A board game according to claim 1, wherein said course means is for traversing a plurality of times by each playing entity to complete a plurality of different levels, with each traverse being performed for each level within said predetermined period of time.

6. A board game according to claim 5, wherein:

said course means includes a plurality of position means for traversing by the playing piece of each playing entity within said predetermined period of time such that each playing entity is required to start at an ending position of the course means at each start of a playing entity's turn.

7. A board game according to claim 5, wherein:

said course means includes a plurality of position means for traversing by the playing piece of each playing entity within said predetermined period of time such that a playing entity is permitted to traverse said course means for a next level after the playing entity has completed traverse of said course means for a level within said predetermined period of time, provided that said predetermined period of time has not elapsed.

8. A board game according to claim 5, further comprising:

bonus card means for additionally rewarding/punishing a playing entity after the playing entity completes a level.

9. A board game according to claim 5, further comprising:

final round question means for answering by a playing entity during the playing entity's turn when:

the playing entity has completed traverse of all levels of said course means, each within said predetermined time period, and the playing entity has accumulated less rewards than another playing entity; and additional reward means for rewarding the playing entity for correctly answering the final round question to enable the playing entity to satisfy both conditions of the winning indication means of completing traverse of said course means within said predetermined time period and accumulating more rewards than any other playing entity, in order to win.

10. A board game according to claim 1, wherein the reward means include monetary rewards.

11. A restaurant theme board game to be played by a plurality of playing entities, comprising:

a playing surface;

a playing piece for each playing entity;

course means on said playing surface for traversing by the playing piece of each playing entity, said course means to be traversed including a plurality of waitress stations on said playing surface such that the playing piece of each playing entity occupies a respective said station, and each waitress station includes a plurality of table means for traversing by the playing piece of the playing entity occupying said station, with each playing entity required to traverse the table means of the waitress station occupied by the playing entity a plurality of times to complete a plurality of different levels, and with each traverse of all table means of the waitress station being performed for each level within a predetermined period of time;

a plurality of traverse question means for answering by each playing entity during that playing entity's turn in order for the playing piece of the playing entity to proceed along the table means of the playing entity's station, said question means including questions regarding at least one of food, drink and restaurant services;

time keeping means for determining when said predetermined time period has expired during a playing entity's turn and for indicating that a playing entity must complete the course means during a subsequent turn when the playing entity has failed to completely traverse all table means of the station occupied by the playing entity during a playing entity's turn;

reward means for rewarding each playing entity for correctly answering the question means during traverse of said course means by the respective playing entity; and winning indication means for indicating a winner of the game as a playing entity which first satisfies both conditions of completely traversing said means at the station occupied by the playing entity for each level within said predetermined time period and accumulating more reward means than any other playing entity, wins the game.

12. A restaurant them board game according to claim 11, further comprising:

bonus card means for additionally rewarding/punishing a playing entity after the playing entity completes a level.

13. A restaurant theme board game according to claim 11, further comprising:

final round question means for answering by a playing entity during the playing entity's turn when:

the playing entity has completed traverse of all levels of said course means, each within said predetermined time period, and the playing entity has accumulated less rewards than another playing entity; and additional reward means for rewarding the playing entity for correctly answering the final round question to enable the playing entity to satisfy both conditions of the winning indication means of completing traverse of said course means within said predetermined time period and accumulating more rewards than any other playing entity, in order to win.

14. A method of playing a board game, comprising the steps of:

requiring a predetermined course to be traversed at least once within a predetermined period of time;

requiring questions to be answered by a playing entity to move a playing piece of the playing entity along said course;

moving said playing piece of the playing entity along said course when said playing entity correctly answers each question during said predetermined period of time;

providing rewards to each playing entity for correctly answering the questions during traverse of said course; and requiring a playing entity to satisfy both conditions of completing traverse of said course within said predetermined time period and accumulating more rewards than any other playing entity, in order to win.

15. A method according to claim 14, wherein said step of providing a predetermined course includes the step of providing a plurality of stations on said playing surface such that each playing entity occupies a respective said station, each station including a plurality of tables forming a course to be traversed by the playing piece of one playing entity within a predetermined time period, and the step of moving said playing piece includes the step of moving said playing piece around the plurality of tables.

16. A method according to claim 14, wherein said step of requiring a predetermined course to be traversed at least once within a predetermined period of time includes the steps of:

requiring a playing entity to traverse said course a plurality of times to complete a plurality of different levels, and requiring a playing entity to traverse said course for each level within said predetermined period of time.

17. A method according to claim 16, wherein said step of requiring a playing entity to traverse said course for each level within said predetermined period of time includes the step of requiring each playing entity to start at an ending position of the course at each start of the playing entity's turn.

18. A method according to claim 16, wherein said step of requiring a predetermined course to be traversed at least once within a predetermined period of time further includes the step of:

permitting a playing entity to traverse said course for a next level after the playing entity has completed traverse of said course for a level within said predetermined period of time, provided that said predetermined period of time has not elapsed.

19. A method according to claim 14, further comprising the steps of:

providing a bonus card to a playing entity after a playing entity completes a level; and adding or subtracting from rewards of the playing entity in accordance with instructions from the bonus card.

20. A method according to claim 14, further comprising the steps of:

providing a final round question to a playing entity during the playing entity's turn when the playing entity has completed traverse of said course within said predetermined time period but has accumulated less rewards than another playing entity; and providing an additional reward to the playing entity for correctly answering the final round question to enable the playing entity to satisfy both conditions of completing traverse of said course within said predetermined time period and accumulating more rewards than any other playing entity, in order to win.

21. A method according to claim 14, wherein said board game has a restaurant theme, with said course including a plurality of waitress stations on said playing surface such that each playing entity occupies a respective said waitress station, each waitress station including a plurality of tables forming the course to be traversed by the playing piece of each playing entity within said predetermined time period.

* * * * *